US006866212B2

(12) United States Patent
Sumiyoshi et al.

(10) Patent No.: US 6,866,212 B2
(45) Date of Patent: Mar. 15, 2005

(54) ELECTROSTATIC SPRAY DEVICE

(75) Inventors: Toru Sumiyoshi, Okayama (JP); Bryan Michael Kadlubowski, Manchester, MD (US); David Edward Wilson, Reistertown, MD (US); Ryan Norris Blystone, Greensboro, NC (US)

(73) Assignee: The Procter & Gamble Company, Cincinnati, OH (US)

( * ) Notice: Subject to any disclaimer, the term of this patent is extended or adjusted under 35 U.S.C. 154(b) by 51 days.

(21) Appl. No.: 10/374,925

(22) Filed: Feb. 25, 2003

(65) Prior Publication Data

US 2004/0021017 A1 Feb. 5, 2004

Related U.S. Application Data

(60) Provisional application No. 60/359,425, filed on Feb. 25, 2002.

(51) Int. Cl.[7] ..... B05B 5/00; B05B 9/04; F23D 11/32

(52) U.S. Cl. ..... 239/690; 239/690.1; 239/691; 239/708; 239/332

(58) Field of Search ..... 239/690, 690.1, 239/691, 708, 332, 692, 704, 706, 319, 320, 329, 331

(56) References Cited

U.S. PATENT DOCUMENTS

| | | | | |
|---|---|---|---|---|
| 4,634,057 | A * | 1/1987 | Coffee et al. | 239/690 |
| 5,292,067 | A * | 3/1994 | Jeffries et al. | 239/3 |
| 6,079,634 | A | 6/2000 | Noakes et al. | |
| 6,311,903 | B1 | 11/2001 | Gaw et al. | |
| 6,318,647 | B1 | 11/2001 | Gaw et al. | |
| 2001/0020652 | A1 | 9/2001 | Kadlubowski et al. | |
| 2001/0022065 | A1 | 9/2001 | Wilson et al. | |
| 2001/0023902 | A1 | 9/2001 | Wilson et al. | |

FOREIGN PATENT DOCUMENTS

| | | | |
|---|---|---|---|
| WO | WO 01/12335 | A1 | 2/2001 |
| WO | WO 01/12336 | A1 | 2/2001 |
| WO | WO 02/055212 | A1 | 7/2002 |

* cited by examiner

*Primary Examiner*—David A. Scherbel
*Assistant Examiner*—Darren Gorman
(74) *Attorney, Agent, or Firm*—Vladimir Vitenberg

(57) ABSTRACT

An electrostatic spraying device being configured and disposed to electrostatically charge and dispense a liquid composition from a supply to a point of dispersal, wherein the device comprises:

a reservoir configured to contain the supply of liquid composition;

a nozzle to disperse the liquid composition, the nozzle being disposed at the point of dispersal;

a channel disposed between the reservoir and the nozzle, wherein the channel permits the electrostatic charging of the liquid composition upon the liquid composition moving within the channel;

a high voltage power supply electrically connected to the power source; and a high voltage electrode electrically connected to the high voltage power supply, wherein a portion of the high voltage electrode is disposed between the reservoir and the nozzle, and wherein the high voltage electrode electrostatically charges the liquid composition within the channel at a charging location, wherein the nozzle pathway comprises an outlet path disposed adjacent to the nozzle, the outlet path having a diameter of from about 0.1 mm to about 1 mm and being a point or having a length of from about 0 mm to about 5 mm, and a main path disposed between the outlet path and the charging location, the main path having a diameter greater than the outlet path to about 5 mm and being straight or outwardly tapered towards the charging location at an angle of from about 0 to about 10 degrees.

20 Claims, 10 Drawing Sheets

ELECTROSTATIC SPRAY DEVICE

CROSS REFERENCE TO RELATED APPLICATION

This application claims the benefit of U.S. Provisional Application No. 60/359,425, filed Feb. 25, 2002.

FIELD

The present invention relates to a portable electrostatic spray device designed for personal use, and a removable cartridge for the portable electrostatic spray device. More specifically, the present invention relates to improvements for providing a good spray quality while being safe for the user, and also for allowing the device and/or cartridge to be manufactured in a convenient, economical manner.

BACKGROUND

Portable electrostatic spray devices useful for spraying liquid compositions, and particularly those which utilize a removable cartridge, are known in patent publications such as WO 01/12336, WO 01/12335, US 2001-0020653A, US 2001-0038047A, US 2001-0020652A, and US 2001-0023902A. As recognized in the art, the design of an electrostatic spray device starts with identifying spray quality factors such as spray droplet diameter, distribution of spray droplet diameter, and spray area at the target distance from the object to be sprayed. To achieve the target spray quality, the output operating variables of the device such as: high voltage output, current output, product flow rate; are balanced with the properties of the liquid composition such as: viscosity, resistivity, surface tension. For a given set of environmental factors; such as temperature and humidity; combined with the device operating variables and liquid composition properties, a particular charge-to-mass ratio exists for a specific target spray quality. The charge-to-mass ratio is a measure of the amount of electrical charge carried by the atomized spray on a per weight basis and may be expressed in terms of coulombs per kilogram (C/kg). The charge-to-mass ratio provides a useful measure to ensure that good spray quality is maintained. A change during spraying in any of the liquid composition properties or device output operating variables will result in a change in the spray quality.

An important factor for providing constant liquid composition properties relates to stability of the liquid composition to be sprayed. Maintaining stability of the liquid composition is particularly important for liquid compositions that are emulsions, thereby having conductive and insulating phases, as high electric field gradients from within the reservoir can cause electrical current to flow through the liquid composition and cause the liquid composition to separate into its conductive and insulating phases. Further, the electrically induced separation of the liquid composition can change one or more of the liquid composition properties, for example, viscosity, resistivity, surface tension, and therefore can change the charge-to-mass ratio of the resulting spray. Separation of the liquid composition per se is disadvantageous for the user, as it may alter the functional performance expected by the liquid composition.

The art provides methods for providing the target charge-to-mass ratio in a consistent manner by, for example, reducing the electric field gradients and in turn preventing electrical current from flowing through the reservoir by incorporating a high voltage shield to stabilize the area surrounding the reservoir and to prevent current leakage from the reservoir to adjacent locations within the device at lower electrical potentials. Another method suggested is to limit the volume of the liquid composition located between the electrode charging location and nozzle, thereby minimizing the volume of liquid composition that has been electrically induced separation. Specifically suggested is a straight narrow nozzle pathway between the electrode charging location and nozzle.

While these methods are successful in providing electrostatic spray devices that are safe upon use and provide good spray quality, it is difficult and/or uneconomical to manufacture the nozzle pathway and its vicinity for mass production, due to difficulty of providing a straight, yet precise small diameter nozzle pathway.

Based on the foregoing, there is a need for a portable electrostatic spray device and/or a removable cartridge for the portable electrostatic spray device; which provides good spray quality while being safe for the user, and which is manufactured in a convenient, economical manner. There is further a need for a portable electrostatic spray device, for spraying an emulsion liquid composition, which can maintain the emulsion liquid composition while spraying. There is further a need for a portable electrostatic spray device, for spraying an emulsion liquid composition, which provide various usage advantages to the user.

None of the existing art provides all of the advantages and benefits of the present invention.

SUMMARY

The present invention is directed to an electrostatic spraying device being configured and disposed to electrostatically charge and dispense a liquid composition from a supply to a point of dispersal, wherein the device comprises:

a reservoir configured to contain the supply of liquid composition;

a nozzle to disperse the liquid composition; the nozzle being disposed at the point of dispersal;

a channel disposed between the reservoir and the nozzle; wherein the channel permits the electrostatic charging of the liquid composition upon the liquid composition moving within the channel;

a power source to supply an electrical charge;

a high voltage power supply; the high voltage power supply being electrically connected to the power source;

a high voltage electrode; the high voltage electrode being electrically connected to the high voltage power supply; a portion of the high voltage electrode being disposed between the reservoir and the nozzle; the high voltage electrode electrostatically charges the liquid composition within the channel at a charging location; and a nozzle pathway disposed between the charging location and the nozzle; the length of the nozzle pathway governed by the following relationship: $Vo/d<4{,}000$; wherein Vo is an output voltage (v) of the high voltage power supply; and d is the length (mm) of the nozzle pathway;

wherein the nozzle pathway comprises an outlet path disposed adjacent the nozzle, the outlet path having a diameter of from about 0.1 mm to about 1 mm and being a point or having a length of from about 0 mm to about 5 mm; and a main path disposed between the outlet path and the charging location, the main path having a diameter greater than the outlet path to about 5 mm and being straight or outwardly tapered towards the charging location at an angle of from about 0 to about 10 degrees; and/or wherein the high voltage electrode comprises an antenna for facilitating flow of the liquid composition in the nozzle pathway; the antenna projecting at substantially the center of the nozzle pathway and having a basal diameter of from about 0.5 mm to about 3 mm, and a height of from about 0.5 mm to about 3 mm.

The present invention is further directed to a removable cartridge for the electrostatic spraying device, as specified above, wherein at least the reservoir, the nozzle, the channel, the high voltage electrode, and the nozzle pathway are comprised in the removable cartridge.

The present invention is still further directed to the electrostatic spraying device and/or removable cartridge, as specified above, comprising the liquid composition in the reservoir, the liquid composition being an emulsion composition comprising: (a) from about 5% to about 75% of an insulating external phase comprising one or more liquid insulating materials; and (b) from about 15% to about 80% of a conductive internal phase comprising one or more conductive materials.

The present invention is still further directed to a method of treating the skin using the electrostatic spraying device as specified above.

The electrostatic spraying device herein provides good spray quality while being safe for the user, and can be manufactured in a convenient, economical manner.

These and other features, aspects, and advantages of the present invention will become better understood from a reading of the following description, and appended claims.

BRIEF DESCRIPTION OF THE FIGURE

While the specification concludes with claims particularly pointing out and distinctly claiming the invention, it is believed that the present invention will be better understood from the following description of preferred, nonlimiting embodiments and representations taken in conjunction with the accompanying drawings in which:

DETAILED DESCRIPTION

Figure 1:
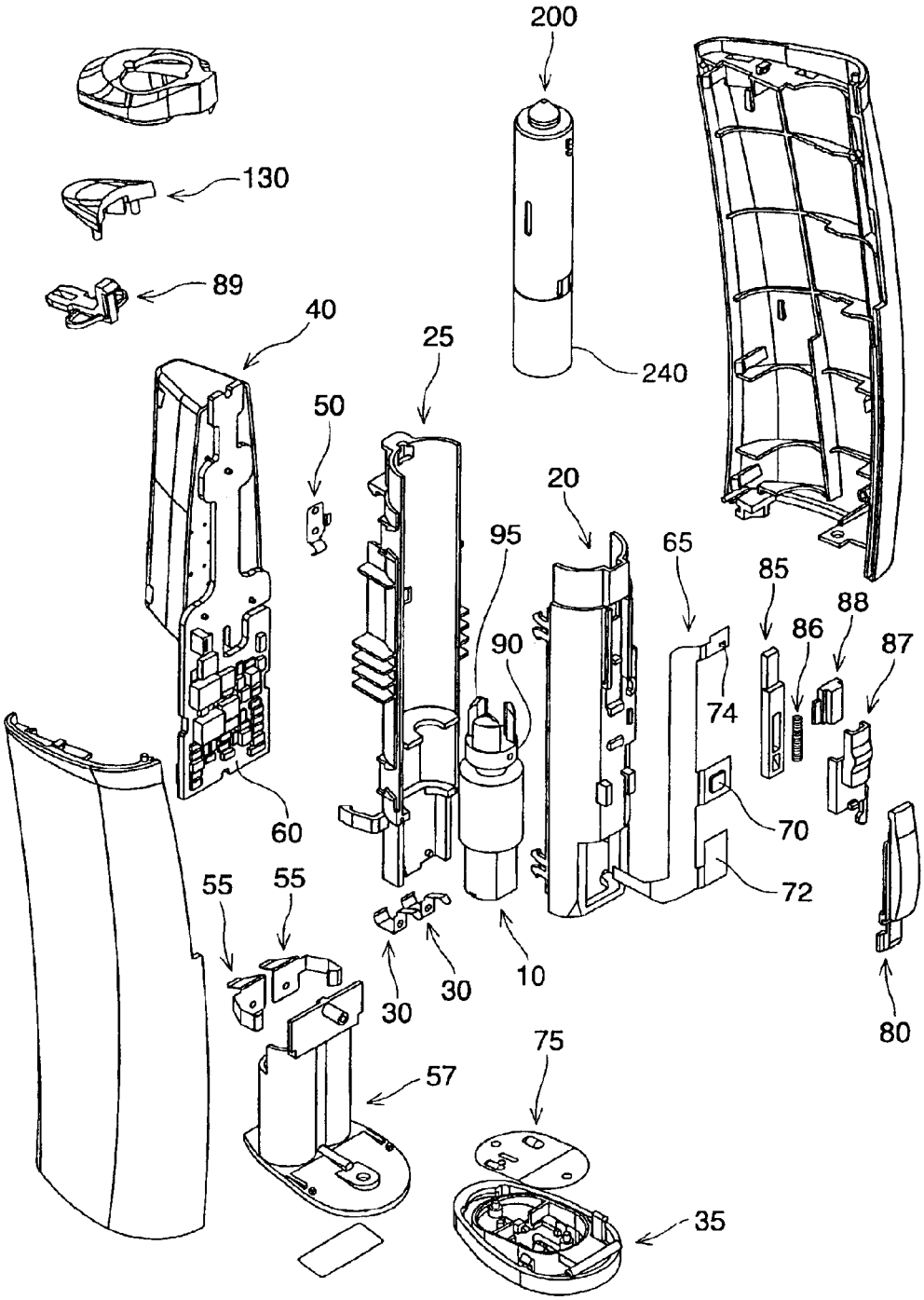
FIG. 1 is an exploded isometric view of a preferred embodiment of the electrostatic spraying device, having a removable cartridge, of the present invention.
Figure 2A:
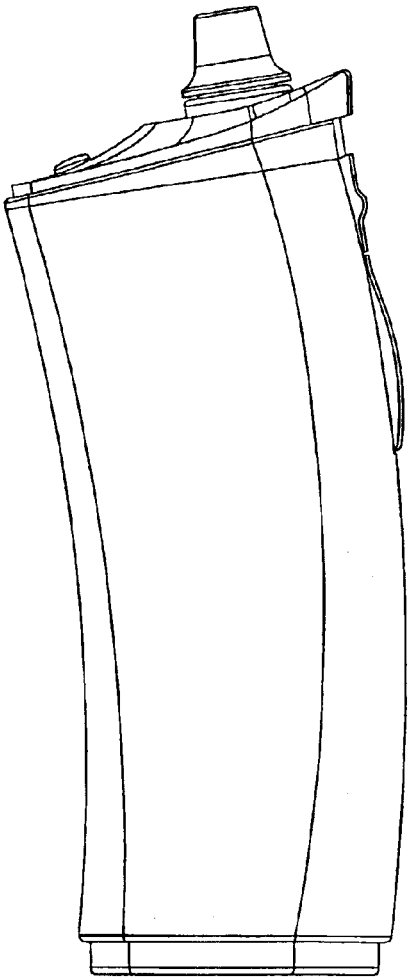
FIG. 2A is an assembled view of the exploded isometric view of the electrostatic spraying device of FIG. 1.
Figure 2B:
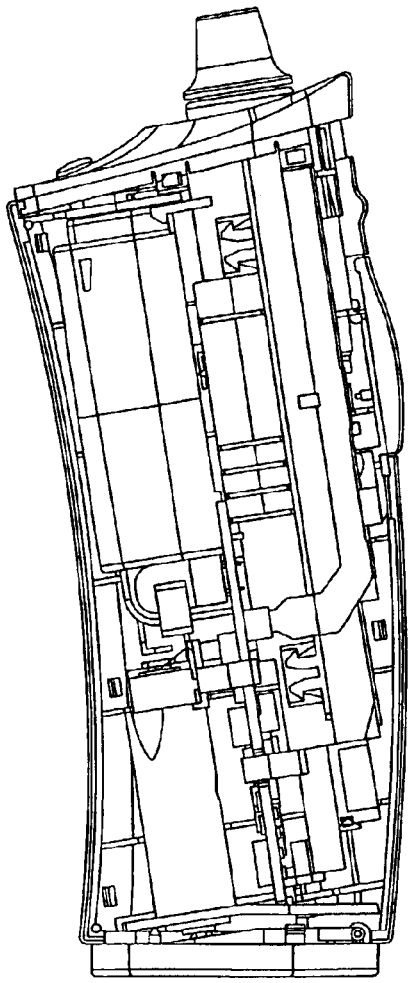
FIG. 2B is an assembled view of the exploded isometric view of the electrostatic spraying device of FIG. 1 with the outer housing removed.

While the specification concludes with claims particularly pointing out and distinctly claiming the invention, it is believed that the present invention will be better understood from the following description.

All cited references are incorporated herein by reference in their entireties. Citation of any reference is not an admission regarding any determination as to its availability as prior art to the claimed invention.

Herein, "comprising" means that other elements which do not affect the end result can be added. This term encompasses the terms "consisting of" and "consisting essentially of".

All percentages, parts and ratios are based upon the total weight of the compositions of the present invention, unless otherwise specified. All such weights as they pertain to listed ingredients are based on the active level and, therefore, do not include carriers or by-products that may be included in commercially available materials.

Herein, "high voltage" means about 1000V or higher voltage. High voltage may be abbreviated "HV" in the present specification.

Herein, "conductive" means about 100 MΩcm or lower conductance.

Herein, "safe" means a state where no or only an unconceivable amount of electric discharge is applied to the user of the electrostatic spraying device.

All ingredients such as actives and other ingredients useful herein may be categorized or described by their cosmetic and/or therapeutic benefit or their postulated mode of action. However, it is to be understood that the active and other ingredients useful herein can, in some instances, provide more than one cosmetic and/or therapeutic benefit or operate via more than one mode of action. Therefore, classifications herein are made for the sake of convenience and are not intended to limit an ingredient to the particularly stated application or applications listed.

Electrostatic Spraying Device

The present invention is related to an electrostatic spraying device being configured and disposed to electrostatically charge and dispense a liquid composition from a supply to a point of dispersal, wherein the device comprises:

a reservoir configured to contain the supply of liquid composition;

a nozzle to disperse the liquid composition; the nozzle being disposed at the point of dispersal;

a channel disposed between the reservoir and the nozzle; wherein the channel permits the electrostatic charging of the liquid composition upon the liquid composition moving within the channel;

a power source to supply an electrical charge;

a high voltage power supply; the high voltage power supply being electrically connected to the power source;

a high voltage electrode; the high voltage electrode being electrically connected to the high voltage power supply; a portion of the high voltage electrode being disposed between the reservoir and the nozzle; the high voltage electrode electrostatically charges the liquid composition within the channel at a charging location; and a nozzle pathway disposed between the charging location and the nozzle.

All of the elements of the electrostatic spraying device as specified above can be disposed in the device comprising a means for supplementing liquid composition, or can be partially disposed in a removable cartridge, wherein the liquid composition is supplemented via exchange of the removable cartridge. In a preferred embodiment, at least the reservoir, the nozzle, the channel, the high voltage electrode, and the nozzle pathway are comprised in the form of a removable cartridge. While other configurations for disposing the elements of the electrical spraying device are possible, the present invention is described herein with reference to the preferred embodiment of utilizing a removable cartridge comprising the reservoir, the nozzle, the channel, the high voltage electrode, and the nozzle pathway.

Referring to FIG. 1, a hand-held, self-contained electrostatic spraying device in an exploded isometric view, along with a removable cartridge 200 is shown. Removable cartridge 200 may contain a variety of liquid compositions. The liquid composition in removable cartridge 200 may be positively displaced and powered by gearbox/motor component 10. Gearbox/motor component 10 may be fixed into a front cartridge silo 20 and rear cartridge silo 25. The gearbox/motor component 10 can be affixed into place mechanically, adhesively, or by any other suitable technique. Gearbox/motor component 10 has a driver 90 fastened. Driver 90 has a number of protruding fingers 95, for example, three, which can fit into the matching recesses on the back of actuator 240 of the removable cartridge 200.

Power supply (not shown) providing power to the device can be fixed into battery holder 57. An example of a suitable power supply includes, but is not limited to, two "AAA" type batteries. The power supply provides the main circuit board 60 with electric power through one or more battery harnesses 55 and battery jumper plate 75. The battery harnesses 55 and battery jumper plate 75 can be fixed onto battery holder 57 and battery lid 35, respectively, by heat melting or any other suitable technique. Battery harnesses 55 and battery jumper plate 75 provide the power supply and the main circuit board 60 with sufficient pressure for secured electric contacts. Battery harnesses 55 and battery jumper plate 75 can be made of, for example, steel with nickel plating.

One or more metal contacts 30 convey electric power from the designated terminals in the main circuit board 60 to the motor housed in the gearbox/motor component 10. The metal contacts 30 provide the main circuit board 60 and motor terminals with sufficient pressure for secured electric contacts. The metal contacts 30 can be made of, for example, steel with nickel plating. The metal contacts 30 can be mechanically fixed onto the rear cartridge silo 25 by heat melting, or any other suitable technique.

The main circuit board 60 generates pulse or AC signal to drive the high voltage power supply 40 to produce the high voltage. The high voltage output contacts the removable cartridge 200 through the high voltage contact 50. High voltage power supply 40 is powered and controlled by main circuit board 60. Flexible circuit board 65, plugged with the main circuit board 60 possesses ground terminal 72, apply switch 70, and power-on indicator 74. Apply switch 70 can be a tactile switch for receiving the physical pressure from spray button 80. The ground terminal 72 and spray button 80 are electrically connected through pressure contact, soldering or any other suitable technique. This electric connection between the ground terminal 72 and spray button 80 establishes a statistical energy drain circuit from the HV electrode to the device ground without building static charge at the user. Spray button 80 permits the user to cause an interruption between power source and circuit control 60. Spray button 80 should be made of or treated with electrically conductive material, for example any metal, carbon and other materials such that electric charge generated at user is effectively drained into the device ground through spray button 80 and ground terminal 72.

An assembly of the front cartridge silo 20 and rear cartridge silo 25, also houses parts which provide additional functions such that removable cartridge 200 can be mounted, locked and ejected with mechanical actions, and such that electric/mechanical operations can be regulated. Spray button 80 and eject push rod 85 are designed such that apply switch 70 cannot be pressed when lock slide 87 is in the locked position or cartridge is absent. Eject spring 86 generates sliding motion to the eject push rod 85 to extrude the cartridge 200. The cartridge 200 can be ejected when ejection button 130 is pressed down to disengage lock latch 89 from the removable cartridge 200.

Nozzle Pathway and High Voltage Electrode

Figure 4A:
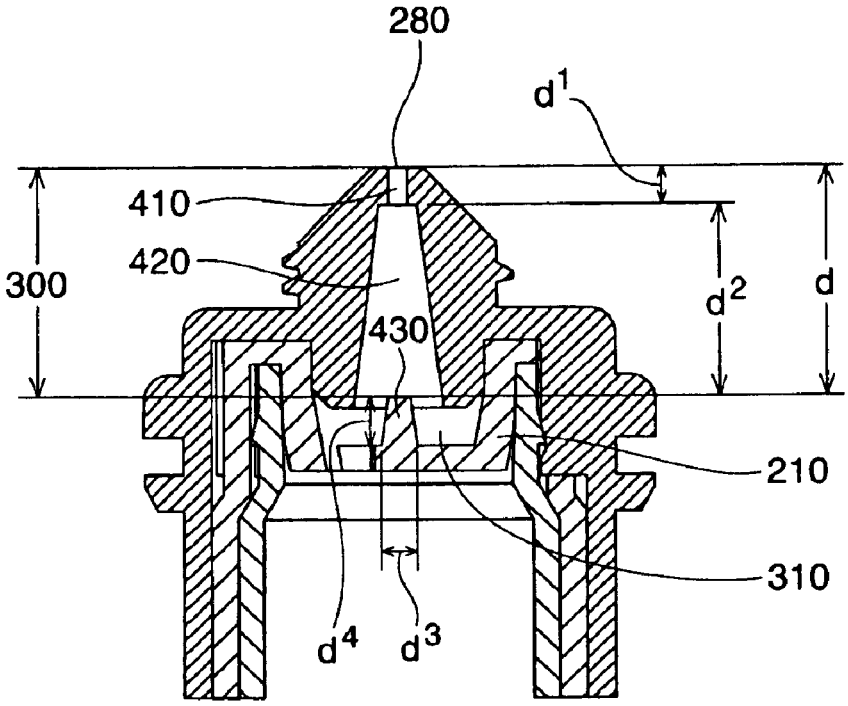
FIG. 4A is a cross-sectional view of a preferred embodiment of the nozzle pathway vicinity of the electrostatic spraying device of the present invention.

The present invention is particularly relevant to the configuration of the nozzle pathway and the high voltage electrode for facilitating flow of the liquid composition in the nozzle pathway, while being manufactured in a convenient and economical way, yet without compromising on safety. Referring to FIG. 4A, a nozzle pathway 300 is defined between the charging location 310 (a point within the open chamber of removable cartridge 200 and also near high voltage electrode 210) and the nozzle 280 (a 2-dimensional exit orifice at which spray exits device). In order to minimize the risk of electrical shock in the form of a tactile discharge to the user, the length of the nozzle pathway 300 is governed by the following relationship: $V_0/d<4{,}000$ wherein $V_0$ is the output voltage (v) of high voltage power supply 40 and d is the length (mm) of the nozzle pathway 300. Preferably, this quotient ($V_0/d$) is less than about 2,700, and more preferably less than about 2,000.

In one aspect of the present invention, within the length of the nozzle pathway 300 as defined above, the nozzle pathway 300 comprises an outlet path 410 disposed adjacent the nozzle 280, and a main path 420 disposed between the outlet path 410 and the charging location 310. The outlet path 410 has a diameter of from about 0.1 mm to about 1 mm, and a length, as represented as $d^1$, of from about 0 mm to about 5 mm, preferably from about 0.5 mm to about 3 mm, more preferably from about 1 mm to about 2 mm.

Figure 4B:
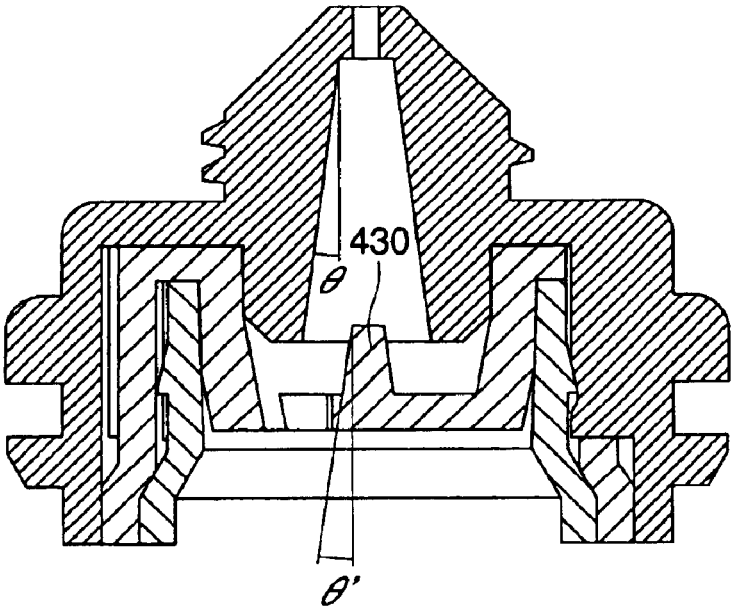
FIG. 4B is an inflated view of FIG. 4A.

When the length of the outlet path 410 is 0 mm, the outlet path 410 is substantially the nozzle 280. The main path 420 has a diameter greater than the outlet path 410, but does not exceed about 7 mm, preferably from about 0.1 mm to about 5 mm, through the length of the main path 420. Referring to FIG. 4B, the main path 420 may be straight or outwardly tapered towards the charging location 310, preferably tapered at an angle, represented as θ, of from about 0 to about 10 degrees, preferably from about 3 to about 7 degrees, more preferably from about 4 to about 6 degrees. Referring back to FIG. 4A, the length of the main path 420, represented by $d^2$, is defined as the difference of the length of the nozzle pathway 300 (d) and the outlet path ($d^1$).

In another aspect of the present invention, the high voltage electrode 210 comprises an antenna 430 projecting at substantially the center of the nozzle pathway 300. The antenna can be made of the same or different material as the high voltage electrode 210, preferably the same material. Referring to FIG. 4B, the antenna 430 is disposed so that there is room left in the area surrounding the antenna for liquid composition to flow outwardly to the nozzle. Referring to FIG. 4A, the antenna 430 has a basal diameter, represented by $d^3$, of from about 0.5 mm to about 7 mm, preferably from about 1 mm to about 4 mm, and a height, represented by $d^4$, of from about 0.5 mm to about 7 mm, preferably from about 1.5 mm to about 4 mm. Referring to FIG. 4B, the antenna 430 may be straight or inwardly tapered towards the nozzle, preferably tapered for ease of manufacturing. When it is tapered, preferably the angle of the taper, represented as θ', is from about 0 to about 30 degrees, more preferably from about 5 to about 15 degrees.

It is known in the art that, electrical shock in the form of a tactile discharge to the user is likely to occur when liquid composition fills nozzle pathway 300, and that this is particularly true for liquid compositions that comprise a conductive phase. Such a condition exists, for example, when the user has already fully dispensed liquid composition from removable cartridge and thus the nozzle pathway 300 is full. For electrostatic spraying devices of the present invention where charging of the liquid composition occurs at a point (charging location 310) remote from the nozzle 280, the ideal situation is for the charging of the liquid composition to occur at a maximum distance away from said nozzle 280, thereby providing the highest degree of safety. However, there does exist a distance, that when charging occurs beyond said distance, the voltage drop within the volume of fluid between said charging location 310 and said nozzle 280 is sufficiently large enough so as to affect the spray formation. Spray formation is affected because the voltage at nozzle 280 is below that needed to form an optimal spray. Further, limiting the liquid composition located in the nozzle pathway 300 by limiting the volume of the nozzle pathway 300 reduced electrically induced separation. Therefore, suggested was a straight narrow nozzle pathway between the electrode charging location 310 and nozzle 280, the nozzle pathway having substantially the same diameter as the nozzle 280.

Surprisingly, it has been found that, by providing a nozzle pathway 300 of the above described configuration of the present invention, a good spraying quality can be obtained, despite the volume of the nozzle pathway 300 is significantly increased. Without being bound by theory, it is believed that, by the configuration of the nozzle pathway 300 of the present invention, liquid composition flows smoothly towards the nozzle with less disturbance of return flow, or with less pressure difference in the nozzle pathway 300. Despite the volume of the nozzle pathway 300 is significantly increased, the amount of discharge leakage is not increased to a level that affects safety. Further, the configurations of the nozzle pathway 300 allows for convenient and economical manufacturing.

Figure 4C:
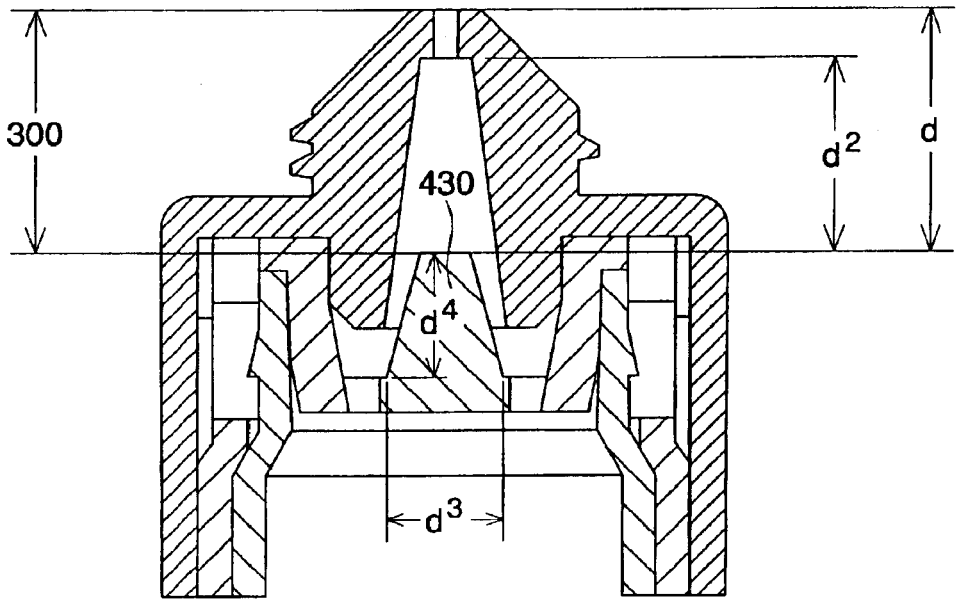
FIG. 4C is a cross-sectional view of another preferred embodiment of the nozzle pathway vicinity of the electrostatic spraying device of the present invention.

The optimum configuration, particularly the length, of the nozzle pathway is determined in view of the specific target spray quality desired for the liquid composition to be sprayed. Output operating variables that are known to affect spray quality are, for example, high voltage output, current output, and product flow rate. Among these variables, the high voltage output is directly affected by the resistance (R) of the liquid composition residing in the nozzle pathway 300. One skilled in the art may decide the length of the nozzle pathway by taking into consideration the following relationship: $R=\rho \times d/A$ wherein ρ is resistivity (Mega ohm-cm) of the liquid composition, d is the length (cm) of the nozzle pathway 300, and A is the cross sectional area ($cm^2$) of the high voltage electrode. Depending on the resistivity of the liquid composition, one skilled in the art may decide an optimum nozzle pathway length that provides the target high voltage output at the nozzle. FIG. 4C depicts yet another preferred embodiment of the nozzle pathway of the present invention.

In another aspect of the present invention, it has also surprisingly been found that, by providing a high voltage electrode 210 comprising an antenna 430 of the above described configuration, a good spraying quality can be obtained. Without being bound by theory, it is believed that the presence of the antenna 430 facilitates flow of the liquid composition towards the nozzle pathway 300 by reducing return flow.

In a particularly preferable embodiment of the present invention, the configurations of the nozzle pathway 300 and the high voltage electrode 210 comprising the antenna 430 are combined. Such combination provides particularly suitable smooth flow of liquid composition in the nozzle pathway 300.

Reservoir

Figure 3:
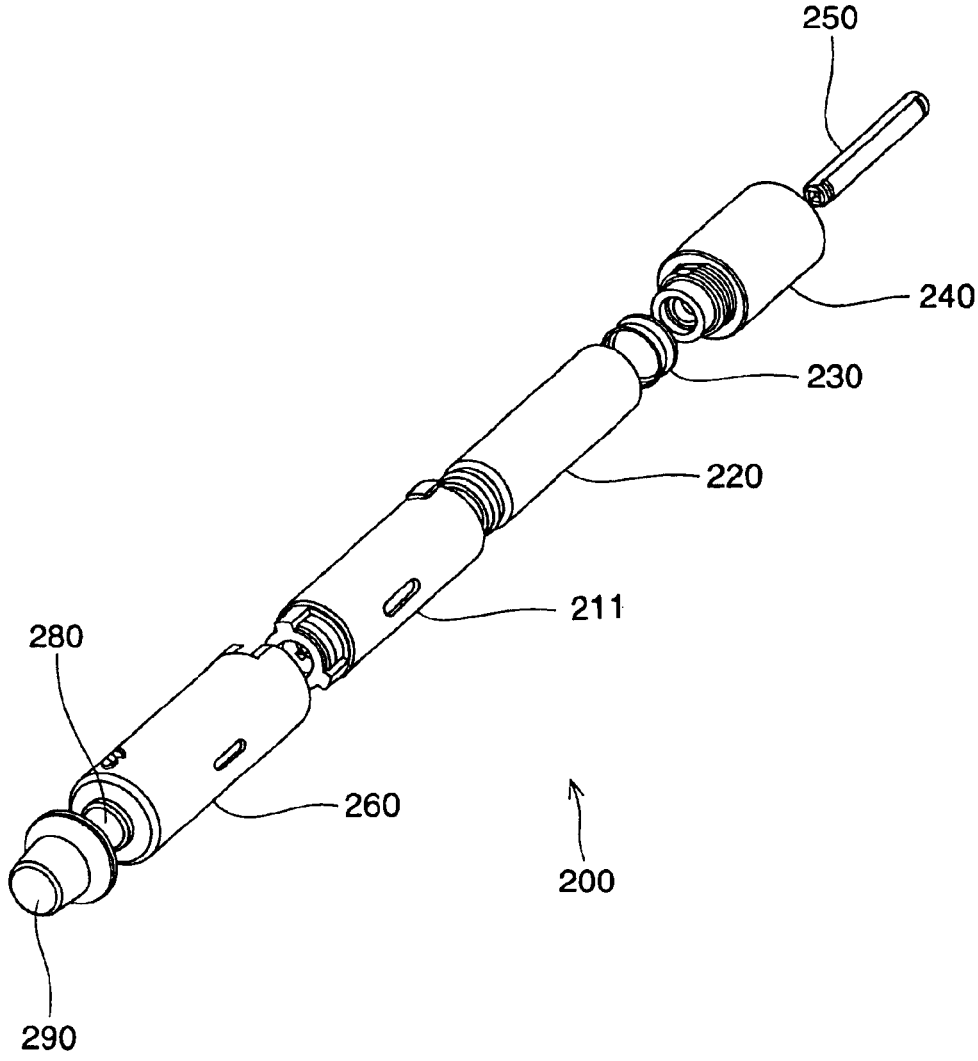
FIG. 3 is an exploded isometric view of a preferred embodiment of the removable cartridge of the present invention.

"In a preferred embodiment of the present invention, the reservoir has other features for providing good spray qualities, and safety features. As shown in FIG. 3, removabl cartridge 200 has a conductive shield 211 which is positioned substantially around the out perimeter of reservoir 220. Conductive shield 211 may be constructed using conductive plastic (e.g. acrylonitrile butadiene styrene (ABS) filled with 10% carbon fibers), metal (e.g. aluminum) or any other suitable material. Conductive shield 211 may be formed as an integral part to cartridge insulator 260, such as through co-injection or two shot molding or any other manufacturing techniques. Alternatively, conductive shield 211 may be formed separately and then later connected to cartridge insulator 260 by any suitable technique, including but not limited to, force fitting. Actuator 240 is located at the non-discharge end of removable cartridge 200. Actuator 240 may have internal threads (not shown) for passage of one end of threaded shaft 250, and a snap bead to snap into an open end of reservoir 220. The opposite end of threaded shaft 250 can have a piston 230 which moves about. The threaded shaft 250 can thereby connect the piston 230 with actuator 240, such that piston 230 can slide along an inner surface of reservoir 220, toward a nozzle 280, in response to the turning of actuator 240 by the gearbox/motor component (not shown). This movement of piston 230 can thus displace liquid composition from the reservoir 220. Referring to FIG. 1, driver 90 has a number of protruding fingers 95, for example, three, which can fit into the matching recesses on the back of actuator 240. Preferably, each of the protruding fingers 95 are so configured to guide the removable cartridge 200 contrary to the rotating direction in which liquid composition is displaced from the reservoir. Such rotation avoids accidental spill of liquid composition upon engaging the removable cartridge 200 in the electrostatic spraying device. Referring back to FIG. 3, a cap 290 is preferably provided to avoid smearing objects touching the nozzle vicinity with residue of liquid composition."

Operating Systems

In a preferred embodiment of the present invention, the electrostatic spraying device of the present invention comprises various output operating systems for maintaining the target charge-to-mass ratio, and thus, maintain good spray quality.

Figure 5:
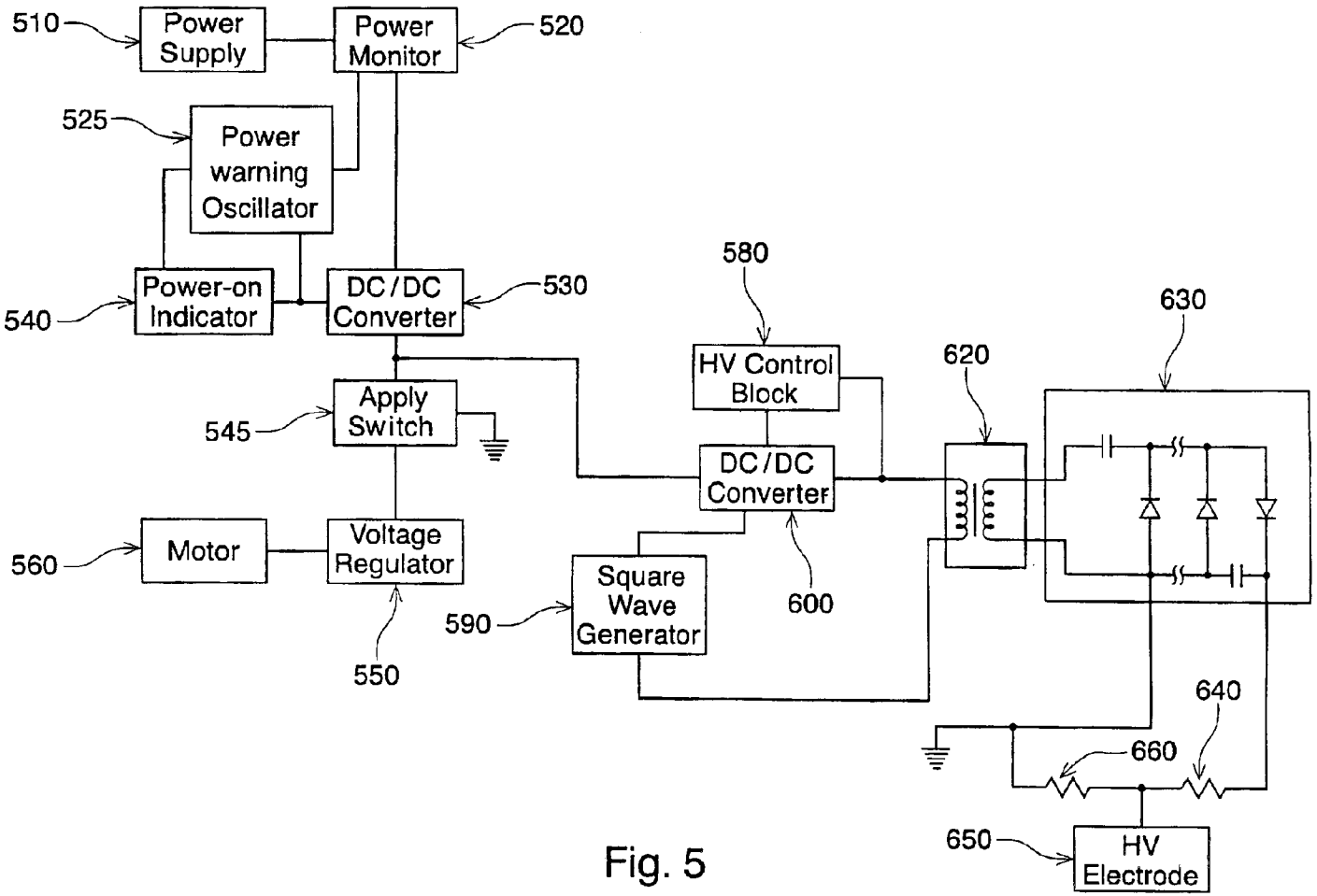
FIG. 5 is a schematic view of the electrical circuitry of a preferred embodiment of the electrostatic spray device of the present invention.

FIG. 5 shows an electrical schematic view of one embodiment of an electrostatic spraying device. The power supply 510 shown can be a battery or other power source known in the art. For example, the power source can be one or more user replaceable battery such as two standard "AAA" batteries. Alternatively, the power source could be user-rechargeable cells, a non-user serviceable rechargeable power pack, or an external source (i.e. "line" supply). In at least one arrangement of the circuitry, power supply 510 can be separated from the rest of the circuit by a power monitor 520. The power monitor 520 can shutdown the total device operation when it detects preset "shut-down" battery voltage. This prevents unstable operation of the device due to insufficient power supply from the battery. The power monitor 520 also activates power warning oscillator 525 when it detects preset "warning" battery voltage. The power warning oscillator 525 then gives blinking signal to power-on indicator 540. In one embodiment, the power monitor 520 can be one or more semiconductor modules, for example, S-80821ANNP-EDJ-T2 available from Seiko Instruments Inc.

The DC/DC Converter 530 receives an input voltage supply from power source 510, for example, a nominal 3.0 volt supply from two conventional "AAA" type batteries, and converts that to a higher voltage signal such as a 5.0 volt supply. The DC/DC Converter 530 can be, for example, a 3 to 5 V DC converter available from Seiko Instruments Inc. (Part number S-8327E50MC-EKE-T2). The DC/DC Converter 530 can also be used to send a signal to power-on indicator 540. This signal can be either a portion of the supply signal from DC/DC converter 530, or an oscillated signal from power warning oscillator 525. The power-on indicator 540, for example, can be an LED that emits light in the red range of the visible electromagnetic (EM) spectrum. The power-on indicator 540 can be arranged to emit continuous visible light when the device is in normal operation with sufficient battery voltage supplied. The power-on indicator 540 can also emit blinking visible light to alert the user to low voltage of the battery. A user controlled apply switch 545 can be pressed or turned to the "on" position, depending on the type of switch employed, to complete the power supply circuit and provide power to the voltage regulator 550. The apply switch 545 can also regulates the upstream DC/DC converter 530 and power warning oscillator 525. More specifically, it can prevent the device from draining battery power during apply switch "off," which can extend battery life. The voltage regulator 550 can control the input voltage to a motor 560. The nominal voltage output from the voltage regulator can be about 3.2 volts.

The HV control block 580 and DC/DC converter 600 can convert input battery voltage to a higher nominal output voltage about 25 volts. HV control block 580 can adjust output voltage generated at DC/DC converter 600. DC/DC converter 600 can be, for example, S-8327E50MC-EKE-T2 from Seiko Instruments Inc. The HV control block 580 can be inserted at DC/DC converter output, which can be, for example a voltage dividing unit consisting of a series of resisters and/or a combination of resisters and zenner diode (s). Square wave generator 590 can oscillate the current flow supplied from DC/DC converter 600 to provide voltage transformer 620 with a square pulse signal at around 4 KHz with 5 micro second width. The Square wave generator 590 can be, for example, an IC comparator from Toshiba Corporation such as part number TC75W57FU.

The turn ratio of the high voltage transformer 620 can be, for example, about 100:1 such that an input voltage of about 25.0 volt at the primary coil would result in about a 2.5 kV (2500 volt) output voltage from the secondary coil. The output voltage from the high voltage transformer 620 can then be supplied to a voltage multiplier 630.

The voltage multiplier 630 rectifies the output signal from the high voltage transformer 620 and multiplies it to provide a higher voltage DC output voltage. If the output voltage of the high voltage transformer 620 is about a 2.5 kV AC signal, for example, the voltage multiplier 630 could rectify this signal and multiply it to provide a higher voltage DC output such as a 14.5 kV DC output voltage. In one embodiment, the voltage multiplier 630 can be a six stage Cockroft-Walton diode charge pump. A stage for a Cockroft-Walton diode charge pump is commonly defined as the combination of one capacitor and one diode within the circuit. One skilled in the art would recognize that the number of stages needed with a voltage multiplier is a function of the magnitude of the input AC voltage source and is dependent upon the required output voltage. In one embodiment, the high voltage transformer 620 and the voltage multiplier 630 can be encapsulated in a sealant such as a silicon sealant such as one available from Shin-Etsu Chemical Company, Ltd. as part number KE1204(A.B)TLV. By encapsulating the high voltage transformer 620 and the voltage multiplier 630 in the sealant, the electrical leakage and corona discharge from these high voltage components can be reduced to increase their efficiency.

A current limiting resistor 640 can be located between the output of high voltage multiplier 630 and the high voltage electrode 650. The current limiting resistor 640 can be used to limit the current output from the high voltage multiplier 630 available to the high voltage electrode 650. In one particular embodiment, the current limiting resistor 640 could be, for example, about 10 MΩ. One skilled in the art would recognize, however, that if a higher output current is desired, then a current limiting resistor with a lower resistance would be desired. Conversely, if a lower output current is desired, then a current limiting resistor with a higher resistance would be desired. The high voltage electrode 650 can be made from a suitable metal or conductive plastic, such as acrylonitrile butadiene styrene (ABS) filled with 10% carbon fibers. A bleeder resistor 660, which is described in more detail below, can also be connected as shown in FIG. 5. A ground contact can also be provided to establish a common ground between the circuitry of the electrostatic spraying device and the user in order to reduce the risk of shocking the user. Further, in personal care applications, the ground contact can also prevent charge from building-up on the skin of the user as the charged particles accumulate on the skin of the user. The ground contact can be integrated into apply switch 545 and/or substantially adjacent to apply switch 545 such that the user cannot energize the motor 560 and the high voltage supply circuitry without simultaneously grounding themselves to the device. For example, the apply switch 545 can be made of or treated with metal material or any other conductive materials. The ground contact can be a conductive contact or a grounding electrode can be located next to apply switch 545.

Locking/Releasing Mechanism

The electrostatic spraying device of the present invention is preferably in a size and weight that is easily held by the hand, and is portable. A locking mechanism is preferably added to secure the device is not activated under certain conditions, so that there is no accidental spraying while, for example, carrying the device in a bag. When a removable cartridge is used, it is also preferred to have mechanisms that facilitate the release of the removable cartridge. To prevent mis-use and accidental direct exposure of high voltage to the user, it is further preferable that the device is not activated when the removable cartridge is absent.

In a preferred embodiment of the present invention, the electrostatic spraying device comprises mechanisms to:

(a) allow activation of the device only when the removable cartridge is placed in the proper position, the lock slide is in the un-locked position and when the spray button is pushed; and (b) prevent activation of the device even when the spray button is pushed, when the removable cartridge is absent or placed in an improper position, or the lock slide is in the locked position.

Figure 6A:
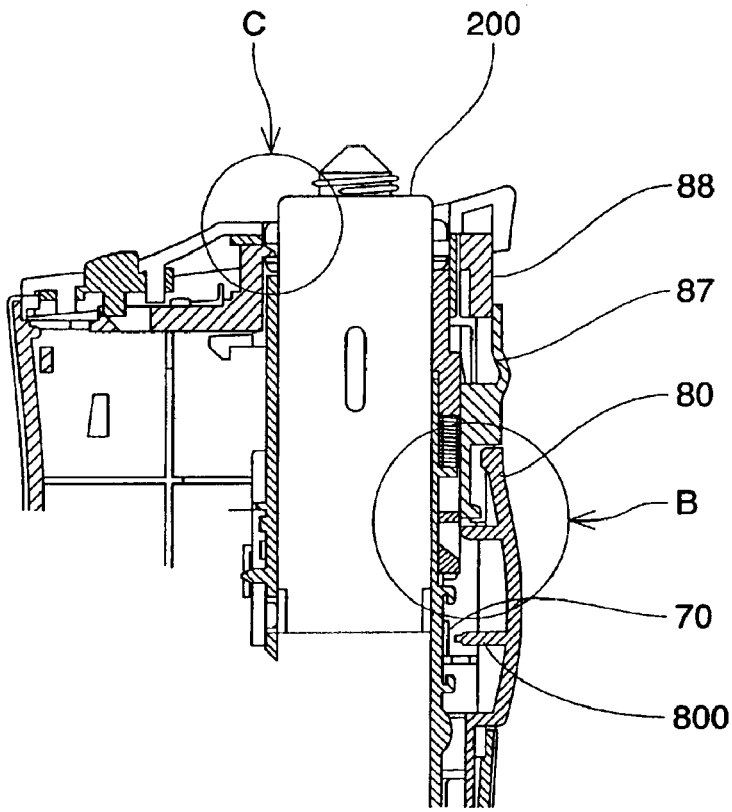
FIG. 6A is a partial cross-sectional view of a preferred embodiment of the electrostatic spraying device, having a removable cartridge inserted, of the present invention, when the lock slide is in the un-locked position.
Figure 6B:
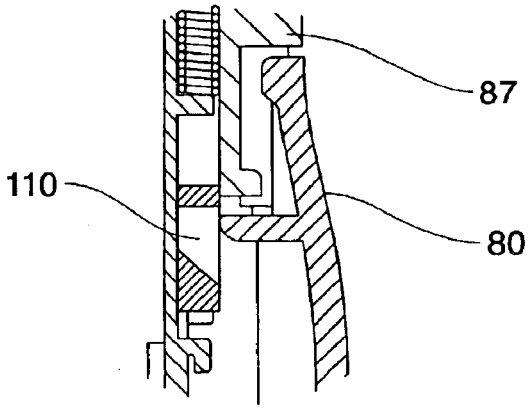
FIG. 6B is an inflated view of FIG. 6A at the vicinity of the lock slide.
Figure 6C:
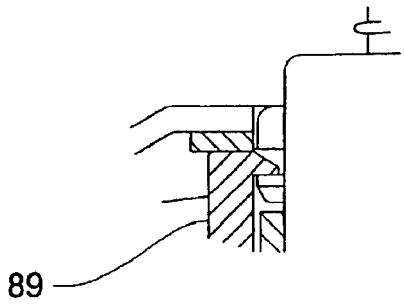
FIG. 6C is an inflated view of FIG. 6A at the vicinity of the lock latch.

FIG. 6A is a partial cross-sectional view of a preferred embodiment of the electrostatic spraying device, having a removable cartridge 200 inserted, when the lock slide 87 is in the un-locked position. As shown in FIG. 6B and FIG. 1, when the lock slide 87 is in this un-locked position, spray button 80 can be physically pressed to engage with the apply switch 70 through window 110 of the eject push rod 85. Referring back to FIG. 6A, when the spray button 80 is pressed, the projected portion 800 of spray button 80 connects with apply switch 70 to activate the device. When the lock slide 87 is in the un-locked position, light guide 88 is exposed such that the power-on indicator 74 (as in FIG. 1) is visible to the user. The power-on indicator 74 can be monitored to check whether there is sufficient power supply for the device to be in an operable mode.

Figure 7A:
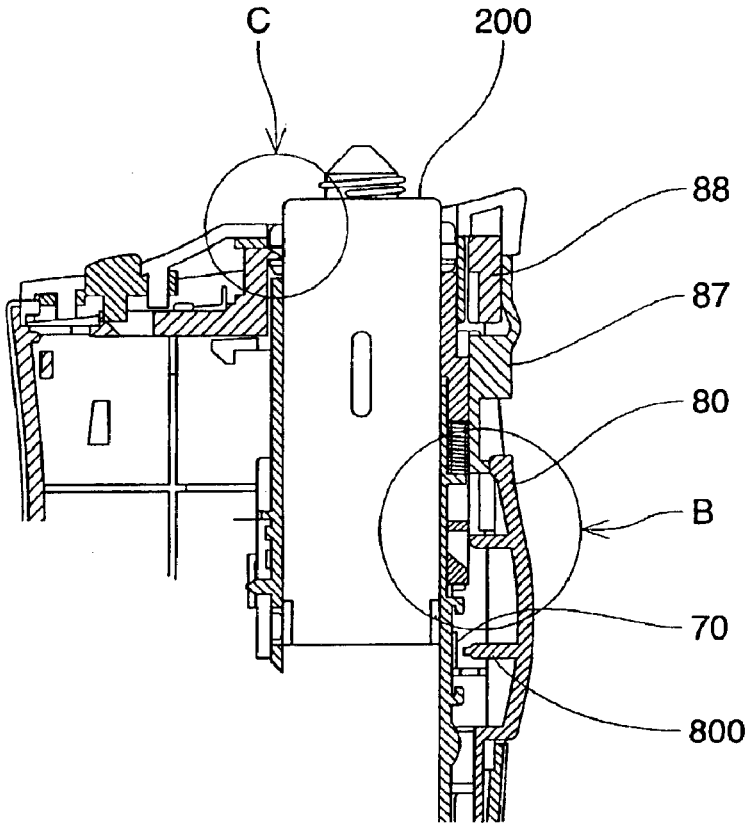
FIG. 7A is a partial cross-sectional view of a preferred embodiment of the electrostatic spraying device, having a removable cartridge inserted, of the present invention, when the lock slide is in the locked position.
Figure 7B:
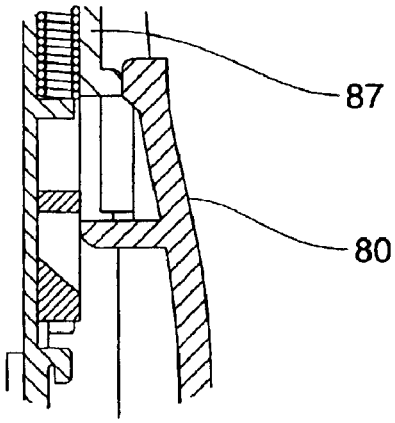
FIG. 7B is an inflated view of FIG. 7A at the vicinity of the lock slide.
Figure 7C:
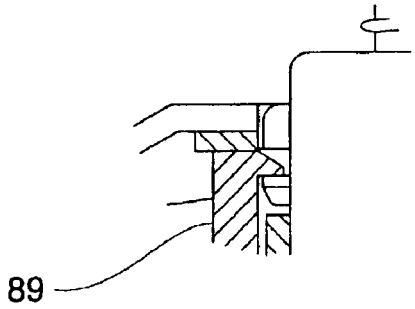
FIG. 7C is an inflated view of FIG. 7A at the vicinity of the lock latch.

FIG. 7A is a partial cross-sectional view of a preferred embodiment of the electrostatic spraying device, having a removable cartridge 200 inserted, when the lock slide 87 is in the locked position. As shown in FIG. 7B and FIG. 1, when the lock slide 87 is in this locked position, the lock slide 87 prevents spray button 80 from being physically pressed to engage in window 110. Thus, referring back to FIG. 7A, the projected portion 800 of spray button 80 cannot touch the apply switch 70 to activate the device. By having such feature, the user may lock the device, for example, when carrying the device in a bag, yet without having to go through the trouble of removing the cartridge. When the lock slide 87 is in the locked position, light guide 88 is blocked and thus the power-on indicator 74 (as in FIG. 1) is not visible to the user, thereby indicating that the device is in an inoperable mode.

Figure 8A:
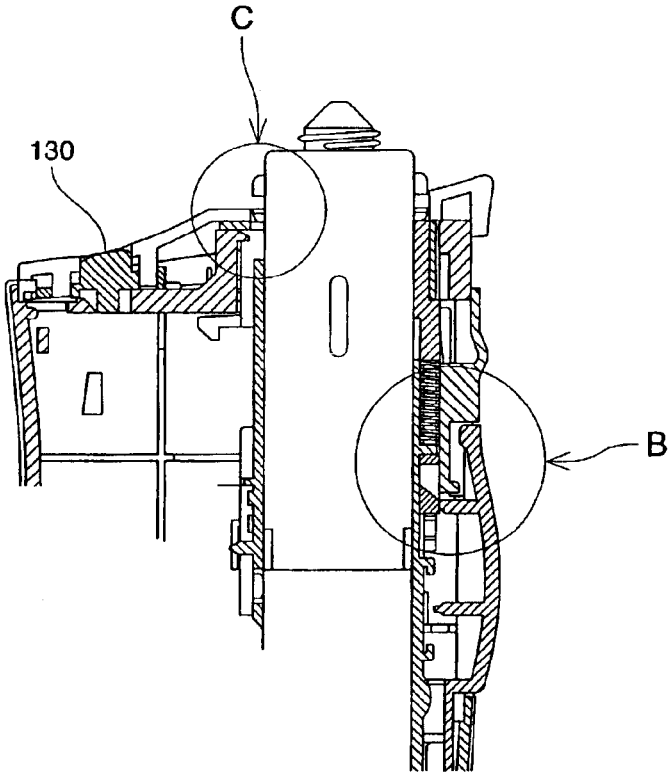
FIG. 8A is a partial cross-sectional view of a preferred embodiment of the electrostatic spraying device, having a removable cartridge inserted, of the present invention, when the ejection button is activated.
Figure 8B:
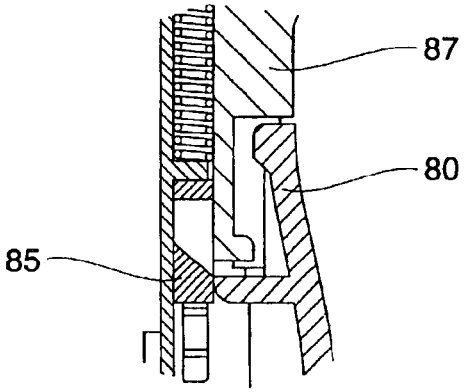
FIG. 8B is an inflated view of FIG. 8A at the vicinity of the lock slide.
Figure 8C:
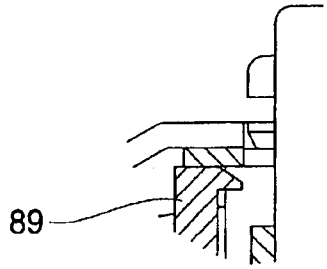
FIG. 8C is an inflated view of FIG. 8A at the vicinity of the lock latch.

FIG. 8A is a partial cross-sectional view of a preferred embodiment of the electrostatic spraying device, either having a removable cartridge 200 inserted in an improper position, or when the ejection button 130 is activated. As shown in FIG. 8C, by pressing the ejection button 130, lock latch 89 releases the projections of the removable cartridge 200, thereby disengaging the removable cartridge 200. Referring back to FIG. 8A, this forces the removable cartridge 200 to move in the direction of the nozzle. In this position, the ejection push rod 85 prevents spray button 80 from being pressed, and thus unable to activate the device.

Figure 9A:
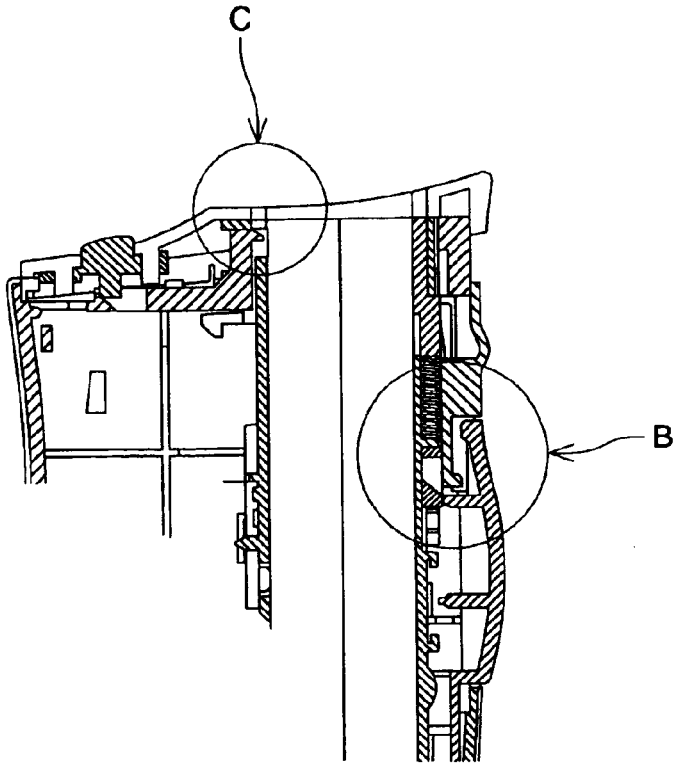
FIG. 9A is a partial cross-sectional view of a preferred embodiment of the electrostatic spraying device of the present invention, when the removable cartridge is absent.
Figure 9B:
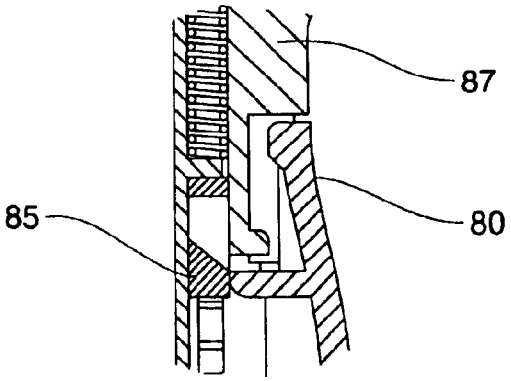
FIG. 9B is an inflated view of FIG. 9A at the vicinity of the lock slide.
Figure 9C:
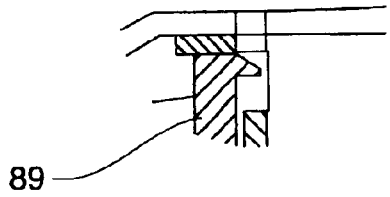
FIG. 9C is an inflated view of FIG. 9A at the vicinity of the lock latch.

FIG. 9A is a partial cross-sectional view of a preferred embodiment of the electrostatic spraying device of the present invention, when the removable cartridge is absent. In this position, the ejection push rod 85 prevents spray button 80 from being pressed, and thus unable to activate the device.

Liquid Composition and Method of Use

The electrostatic spraying device of the present invention is suitable for spraying various liquid compositions of various purposes. In view of the safety features provided for the device as described above, the device of the present invention is particularly suitable for personal use. Further, the device of the present invention provides good spray quality even when liquid compositions having a conductive phase are used, particularly emulsion compositions.

In another aspect of the present invention, the electrostatic spraying device comprises a liquid composition in the reservoir, the liquid composition being an emulsion composition comprising (a) an insulating, continuous external phase comprising one or more liquid insulating materials, and (b) a conductive, discontinuous internal phase comprising one more conductive materials which may be in liquid or particulate form. The reservoir may be comprised in a removable cartridge. The conductive internal phase exists as droplets or particles dispersed in the insulating external phase. The present invention also relates to a method of treating the skin by using the electrostatic spraying device described directly above, the liquid composition sprayed by the electrostatic spraying device providing some esthetic or functional benefit to the skin, which may be the insulating, conductive or other material.

The liquid compositions hereof are electrostatically sprayable to the skin by raising the liquid composition to be sprayed to a sufficiently high electric potential in the device to cause the liquid composition to atomize as a spray of electrically charged droplets. The electrically charged droplets seek the closest earthed object to discharge their electric charge, which can be arranged to be the desired spray target.

In order to be electrostatically sprayable, a liquid composition must have a resistivity which enables atomization as a spray of the charged droplets. In preferred liquid compositions, the components of the liquid composition are selected or adjusted such that the liquid composition has a resistivity of from about 0.01 to about 5000 Mega-ohm-cm, more preferably from about 0.01 to about 2000 Mega-ohm-cm, most preferably from about 0.1 to about 500 Mega-ohm-cm. Resistivity is measured using standard, conventional apparatus and methods, generally at 25 degree C. Resistivity can be adjusted as necessary by varying the relative levels of insulating materials and conductive materials. In general, resistivity decreases with increasing percentage of conductive materials and decreasing percentage of insulating materials.

The liquid compositions must also have a viscosity which permits electrostatic spraying. Materials of a wide range of viscosities may be suitable for use in the present invention, however the viscosity is preferably sufficiently high to minimize wicking of the liquid composition droplets as they are applied to the skin. The tendency to wick depends on the surface tension of the liquid composition and tends to increase with decreasing surface tension of the liquid components. In liquid compositions based on liquid components having a relatively low surface tension (i.e., which have a tendency to wet the substrate), it is generally desirable to utilize a viscosity increasing agent to minimize wicking such as the structuring agents or thickeners described herein. Preferably the viscosity is in the range of from about 0.1 to about 50,000 mPas, more preferably from about 0.5 to about 20,000 mPas, most preferably from about 5 to about 10,000 mPas (at 25 degree C., using 60 mm parallel plate with 0.5 mm gap at rate of 10 $sec^{-1}$).

Insulating External Phase

The insulating external phase comprises one or more insulating materials such that the insulating phase as a whole would not be suitable for electrostatic spraying (that is, it would not be able to cause sufficient alignment of the dipole molecules in the field to result in the subsequent, necessary net force). This phase preferably has a resistivity of about 2000 Mega-ohm-cm or more, more preferably about 5000 Mega-ohm-cm or more. This phase is fluid and comprises at least one insulating liquid material, preferably having a viscosity of about 10,000 mPas or less.

Suitable insulating materials are selected from non-polar substances, e.g. oils and other hydrophobic materials. The insulating materials may be volatile (i.e., having a measurable vapor pressure at 1 atm) or non-volatile, although volatile materials are preferred. Preferred liquid insulating materials have a viscosity of about 10,000 mPas or less. In addition to the at least one liquid insulating material, the liquid composition may comprise non-liquid insulating materials. Preferred insulating materials are selected from the group consisting of volatile silicones, volatile hydrocarbons, and mixtures thereof.

Suitable volatile silicones include cyclic polyalkylsiloxanes represented by the chemical formula $[SiR_2—O]_n$ wherein R is an alkyl group (preferably R is methyl or ethyl, more preferably methyl) and n is an integer from about 3 to about 8, more preferably n is an integer from about 3 to about 7, and most preferably n is an integer from about 4 to about 6. When R is methyl, these materials are typically referred to as cyclomethicones. Commercially available cyclomethicones include Dow Corning® 244 fluid having a viscosity of 2.5 centistokes, and a boiling point of 172° C., which primarily contains the cyclomethicone tetramer (i.e. n=4), Dow Corning® 344 fluid having a viscosity of 2.5 centistokes and a boiling point of 178° C., which primarily contains the cyclomethicone pentamer (i.e. n=5), Dow Corning® 245 fluid having a viscosity of 4.2 centistokes and a boiling point of 205° C., which primarily contains a mixture of the cyclomethicone tetramer and pentamer (i.e. n=4 and 5), and Dow Corning® 345 fluid having a viscosity of 4.5 centistokes and a boiling point of 217°, which primarily contains a mixture of the cyclomethicone tetramer, pentamer, and hexamer (i.e. n=4, 5, and 6). Dow Corning® 244 fluid and Dow Corning® 344 fluid are preferred cyclomethicones.

Other suitable volatile silicones are linear polydimethyl siloxanes having from about 3 to about 9 silicon atoms and the general formula $(CH_3)_3Si—O—[—Si(CH_3)_2—O—]—_n—Si(CH_3)_3$ where n=0–7. These silicones are available from various sources including Dow Corning Corporation and General Electric.

Suitable volatile hydrocarbons include those having boiling points in the range of 60–260° C., more preferably hydrocarbons having from about $C_8$ to about $C_{20}$ chain lengths, most preferably $C_8$ to $C_{20}$ isoparaffins. Preferred isoparaffins are isododecane, isohexadecane, isoeocosane, 2,2,4-trimethylpentane, 2,3-dimethylhexane and mixtures thereof, isododecane, isohexadecane, isoeocosane, and mixtures thereof being more preferred. Most preferred is isododecane, for example available as Permethyl 99A from Permethyl Corporation.

Conductive Internal Phase

The conductive internal phase comprises one or more electrically conductive materials such that the liquid composition as a whole can, when in the presence of a non-uniform electric field, generate dielectrophoretic forces great enough to pull the liquid composition toward the region of highest field intensity (hence creating an electrostatic spray). The conductive internal phase preferably has a resistivity of less than 5000 Mega-ohm-cm, more preferably less than about 2000 Mega-ohm-cm, most preferably less than about 500 Mega-ohm-cm. This phase preferably also has a relaxation time which is sufficiently long to enable a spray wherein all of the droplets have a size of less than 300 microns by standard light microscopy techniques. The conductive internal phase preferably has a relaxation time of from about 1E-7 to 1 seconds, more preferably from about 1E-6 to 1E-2 seconds, most preferably from about 1E-5 to 1E-3 seconds. The conductive internal phase exists as droplets or particles dispersed in the insulating external phase.

The electrically conductive materials comprise one or more polar substances. The conductive materials may be liquid or non-liquid (e.g., solid particles), and volatile or non-volatile, although volatile liquid materials are preferred. Suitable solid particles include metal powders, particles coated with metal or other conductive material, charged species (e.g., salts such as NaCl, or salts used conventionally in buffers in personal care liquid compositions), and hydrophilic coated polymeric particles. Suitable liquids include polar solvents, polar aprotic solvents, glycols, polyols and mixtures thereof. Preferred conductive materials are selected from the group consisting of water, alcohols, glycols, polyols, ketones, solid particles, and mixtures thereof, more preferably alcohols, glycols, polyols (typically comprising about 16 or less carbon atoms) and mixtures thereof. More preferred conductive materials are propylene glycol, butylene glycol, dipropylene glycol, phenyl ethyl alcohol, ethanol, isopropyl alcohol, glycerin, 1,3-butanediol, 1,2-propane diol, isoprene glycol, acetone, water, or a mixture thereof. Particularly preferred conductive materials are propylene glycol, butylene glycol, ethanol, glycerin, water, or a mixture thereof. The conductive material of the internal phase is more preferably selected from propylene glycol, ethanol, and mixtures thereof, and is most preferably propylene glycol.

The liquid compositions hereof are more preferably non-aqueous or contain only a small amount of water, e.g., less than about 10% by weight, preferably less than about 5% by weight, even more preferably less than about 1% by weight water. This is because, due to its short relaxation time and low resistivity, liquid compositions containing large amounts of water generally create sprays which are difficult to control in terms of droplet size and spacing when electrostatic means are used.

The relative levels of the external phase and internal phase may vary, provided that sufficient conductive internal phase is present such that the liquid composition realizes the electrical potential during spraying. The liquid compositions preferably comprise (i) from about 5% to about 75%, more preferably from about 15% to about 70%, most preferably from about 20% to about 60%, of the insulating external phase and (ii) from about 15% to about 80%, more preferably from about 20% to about 75%, most preferably from about 30% to about 70% of the conductive internal phase. In general, sprayability improves with the level of conductive internal phase such that it will normally be advantageous to maximize the level of conductive phase. Preferred liquid compositions comprise a weight ratio of insulating external phase to conductive internal phase (disregarding any non-conductive particulate materials) of from about 0.2:1 to about 8:1, more preferably about 1:1.

Optional Components

The liquid compositions hereof may further comprise a component for providing some esthetic or functional benefit to the skin, e.g., sensory benefits relating to appearance, smell, or feel, therapeutic benefits, or prophylactic benefits. As will be recognized by the artisan having ordinary skill in the art, the above-described materials may themselves provide such benefits. In addition, the present liquid compositions may comprise a variety of other ingredients such as are conventionally used in topical liquid compositions.

Components for the liquid compositions of the present invention are preferably generally liquid in form. Any adjunct materials which are present may be liquid, solid or semi-solid at room temperature, though they should be selected so not to deprive the liquid composition of being electrostatically sprayable. For enhancing electrostatic spraying, preferred liquid compositions have solids content of about 35 weight % or less. In this regard, solids refers to particulate materials which are not soluble or miscible in the liquid composition, and includes particulate pigments and oil absorbers. The deposition of the liquid composition on the skin, including spray droplet size and spacing and skin coverage, is influenced by the product spray flow rate, the rate of product application to the skin, and the amount of product applied to the skin. In general, droplet size increases with increasing resistivity, decreasing voltage, and increasing flow rate, spacing increases with increasing voltage and decreasing deposition amount, and coverage increases with increasing flow rate and increasing deposition amount. In a particularly preferred embodiment, the droplets are applied in the form of a discontinuous film having a size of from about 0.5 to about 150 microns.

In a preferred embodiment the liquid composition is in the form of a cosmetic foundation. As used hereinafter, the term "foundation" refers to a liquid or semi-liquid skin cosmetic which includes, but is not limited to lotions, creams, gels, pastes, and the like. Typically the foundation is used over a large area of the skin, such as over the face, to provide a particular look. Preferred cosmetic foundations of the invention may comprise one or more ingredients selected from the group consisting of film forming polymers, particulate pigments, and mixtures thereof.

Film Forming Polymer

One or more materials for imparting film forming or substantive properties may be used in the present liquid compositions, e.g., to provide long wear and/or transfer resistant properties. Such materials are typically used in an amount of from about 0.5% to about 20%.

Such materials include film forming polymeric materials. While the level of film forming polymeric material may vary, typically the film forming polymeric material is present in levels of from about 0.5% to about 20% by weight (e.g., from about 1 to about 15%), preferably from about 0.5% to about 10% by weight, more preferably from about 1% to about 8% by weight.

The film forming polymeric material may be soluble or dispersible in the internal or external phase, however in a preferred embodiment it is soluble or dispersible in the external phase. Preferred polymers form a non-tacky film which is removable with water used with cleansers such as soap.

Examples of suitable film forming polymeric materials include:

a) sulfopolyester resins, such as AQ sulfopolyester resins, such as AQ29D, AQ35S, AQ38D, AQ38S, AQ48S, and AQ55S (available from Eastman Chemicals);
b) polyvinylacetate/polyvinyl alcohol polymers, such as Vinex resins available from Air Liquid compositions, including Vinex 2034, Vinex 2144, and Vinex 2019;
c) acrylic resins, including water dispersible acrylic resins available from National Starch under the trade name "Dermacryl", including Dermacryl LT;
d) polyvinylpyrrolidones (PVP), including Luviskol K17, K30 and K90 (available from BASF), water soluble copolymers of PVP, including PVP/VA S-630 and W-735 and PVP/dimethylaminoethylmethacrylate Copolymers such as Copolymer 845 and Copolymer 937 available from ISP, as well as other PVP polymers disclosed by E. S. Barabas in the *Encyclopedia of Polymer Science and Engineering,* 2 Ed. Vol. 17 pp. 198–257;
e) high molecular weight silicones such as dimethicone and organic-substituted dimethicones, especially those with viscosities of greater than about 50,000 mPas;
f) high molecular weight hydrocarbon polymers with viscosities of greater than about 50,000 mPas;
g) organosiloxanes, including organosiloxane resins, fluid diorganopolysiloxane polymers and silicone ester waxes.

Preferred film forming polymers include organosiloxane resins comprising combinations of $R_3SiO_{1/2}$ "M"units, $R_2SiO$ "D" units, $RSiO_{3/2}$ "T" units, $SiO_2$ "Q" units in ratios to each other that satisfy the relationship $R_nSiO_{(4-n)/2}$ where n is a value between 1.0 and 1.50 and R is a methyl group. Note that a small amount, up to 5%, of silanol or alkoxy functionality may also be present in the resin structure as a result of processing. The organosiloxane resins must be solid at about 25° C. and have a molecular weight range of from about 1,000 to about 10,000 grams/mole. The resin is soluble in organic solvents such as toluene, xylene, isoparaffins, and cyclosiloxanes or the volatile carrier, indicating that the resin is not sufficiently crosslinked such that the resin is insoluble in the volatile carrier. Particularly preferred are resins comprising repeating monofunctional or $R_3SiO_{1/2}$ "M" units and the quadrafunctional or $SiO_2$ "Q" units, otherwise known as "MQ" resins as disclosed in U.S. Pat. No. 5,330,747, Krzysik, issued Jul. 19, 1994, incorporated herein by reference. In the present invention the ratio of the "M" to "Q" functional units is preferably about 0.7 and the value of n is 1.2. Organosiloxane resins such as these are commercially available such as Wacker 803 and 804 available from Wacker Silicones Corporation of Adrian Michigan, and G. E. 1170-002 from the General Electric Company.

Particulate Pigment

The liquid compositions hereof may comprise one or more powder materials, which are generally defined as dry, particulate matter having a particle size of from 0.001 to 150 microns, preferably 0.01 to 100 microns. The powder materials may be colored or non-colored (e.g., white or essentially clear), and may provide one or more benefits to the liquid composition or skin such as coloration, light diffraction, oil absorption, translucency, opacification, pearlescence, matte appearance, lubricious feel, skin coverage and the like. These materials are well known in the art and are commercially available. Selection of the type and level of a given powder material for a particular purpose in a given liquid composition is within the skill of the artisan. Preferred ranges of non-conductive particulate matter are about 0.1 to about 35% of the total liquid composition. Foundation compositions of the invention typically comprise from about 2% to about 20% pigment for coloration, and from about 2% to about 15% of additional non-pigmented particulates.

Suitable powders include various organic and inorganic pigments which color the liquid composition or skin. Organic pigments are generally various types including azo, indigoid, triphenylmethane, anthraquinone, and xanthine dyes which are designated as D&C and FD&C blues, browns, greens, oranges, reds, yellows, etc. Inorganic pigments are generally insoluble metallic salts of certified color additives, referred to as lakes or iron oxides. Suitable pigments include those generally recognized as safe, and listed in C.T.F.A. *Cosmetic Ingredient Handbook*, First Edition, Washington D.C. (1988, incorporated herein by reference. Specific examples are red iron oxide, yellow iron oxide, black iron oxide, brown iron oxide, ultramarine, FD&C Red, Nos. 2, 5, 6, 7, 10, 11, 12, 13, 30 and 34; FD&C Yellow No. 5, Red 3, 21, 27, 28, and 33 Aluminum Lakes, Yellow 5, 6, and 10 Aluminum Lakes, Orange 5 Aluminum Lake, Blue 1 Aluminum Lake, Red 6 Barium Lake, Red 7 Calcium Lake, and the like.

Other useful powder materials include talc, mica, titanated mica (mica coated with titanium dioxide), iron oxide titanated mica, magnesium carbonate, calcium carbonate, magnesium silicate, silica (including spherical silica, hydrated silica and silica beads), titanium dioxide, zinc oxide, nylon powder, polyethylene powder, ethylene acrylates copolymer powder, methacrylate powder, polystyrene powder, silk powder, crystalline cellulose, starch, bismuth oxychloride, guanine, kaolin, chalk, diatomaceous earth, microsponges, boron nitride and the like. Additional powders useful herein are described in U.S. Pat. No. 5,505,937 issued to Castrogiovanni et al. Apr. 4, 1996.

Of the components useful as a matte finishing agents, low luster pigment, talc, polyethylene, hydrated silica, kaolin, titanium dioxide, titanated mica and mixtures thereof are preferred.

Micas, boron nitride and ethylene acrylates copolymer (e.g., EA-209 from Kobo) are preferred for imparting optical blurring effects through light diffraction and improving skin feel, e.g., by providing a lubricious feel. Another particulate material for improving skin feel is SPCAT I2 (a mixture of talc, polyvinylidene copolymer and isopropyl titanium triisostearate).

Preferred powders for absorbing oil are spherical, non-porous particles, more preferably having a particle size less than 25 microns. Examples of some preferred oil absorbing powders are Coslin C-100 (a spherical oil absorber commercially available from Englehard), Tospearl (spherical silica commercially available Kobo Industries), ethylene acrylates copolymer such as noted above, and SPCAT I2.

The powders may be surface treated with one or more agents, e.g., with lecithin, amino acids, mineral oil, silicone oil, or various other agents, which coat the powder surface, for example, to render the particles hydrophobic or hydrophilic. Such treatment may be preferred to improve ease of formulation and stability. Hydrophobically treated powders are preferred in the present liquid compositions, since they are more easily dispersed in the external phase. Where the external phase comprises silicone, preferred hydrophobic powder treatments include polysiloxane treatments such as those disclosed in U.S. Pat. No. 5,143,722, incorporated herein by reference.

It is generally preferred that the conductive internal phase and insulating external phase have different affinities for powders or skin active materials to be deposited on the skin. More preferably, such materials are not dispersible or soluble in the internal phase. For example, a preferred liquid composition comprises a relatively polar and/or high viscosity conductive fluid with relatively non-polar pigments. Without intending to be bound or limited by theory, it is believed that such incompatibility creates voids within a sprayed droplet which result in smaller clusters of pigments within a sprayed droplet, which in turn give the appearance of smaller droplets than what is actually sprayed (that is, the apparent droplet size is smaller than the actual sprayed droplet size). In general, it will therefore be desirable to select pigments and conductive materials such that the pigments are minimally wetted by the conductive internal phase.

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention. Where applicable, ingredients are identified by chemical or CTFA name, or otherwise defined below.

Device Examples 1–2

Example 1

An electrostatic spraying device having the configurations of FIG. 4A with the following dimensions where made: d=8.98 mm, d2=7.46 mm, d3=1.50 mm, d4=2.05 mm.

Example 2

An electrostatic spraying device having the configurations of FIG. 4C with the following dimensions where made: d=7.19 mm, d2=5.67 mm, d3=3.56 mm, d4=3.84 mm.

Composition Examples 1–10

Cosmetic foundations are made by combining the following ingredients according to following preparation methods:

| Ingredient | Ex 1 | Ex 2 | Ex 3 | Ex 4 | Ex 5 |
|---|---|---|---|---|---|
| Group A | | | | | |
| Cyclopentasiloxane | 15.65 | 15.81 | 14.88 | 15.55 | 13.22 |
| Quaternium-18 Hectorite Gel[1] | 3.00 | | | | |
| Disteardimonium Hectorite Gel[2] | | | 3.00 | | |
| Cyclopentasiloxane & Dimethicone Copolyol[3] | 12.13 | 11.46 | 10.74 | 10.40 | 10.40 |
| Cetyl Dimethicone Copolymer[4] | 0.30 | 0.50 | 0.52 | 0.50 | 0.50 |
| Group B | | | | | |
| Hydrophobically-treated Titanium Dioxide | 4.41 | 12.03 | 5.51 | 5.35 | 5.35 |
| Hydrophobically-treated Yellow Iron Oxide | 0.88 | 2.45 | 0.65 | 0.64 | 0.64 |
| Hydrophobically-treated Red Iron Oxide | 0.20 | 0.50 | 0.14 | 0.13 | 0.13 |
| Hydrophobically-treated Black Iron Oxide | 0.05 | 0.09 | 0.08 | 0.08 | 0.08 |
| Group C | | | | | |
| Hydrophobically-treated Micronized (less than 3 microns) Titanium Dioxide | | 0.79 | 0.17 | 0.16 | 0.16 |
| Polymethylsilsesquioxane | 1.50 | 3.00 | 3.09 | 3.00 | 3.00 |
| Boron Nitride | 1.50 | 3.00 | 3.09 | 3.00 | 3.00 |
| Hydrophobically-treated Talc | 1.60 | 4.37 | 3.13 | 3.02 | 3.02 |
| Trimethylsiloxysilicate[5] | 2.50 | 3.00 | 3.00 | 3.00 | 10.00 |
| Group D | | | | | |
| Propylene Glycol | 56.28 | 43.00 | 52.00 | 55.17 | 50.50 |

| Ingredient | Ex 6 | Ex 7 | Ex 8 | Ex 9 | Ex 10 |
|---|---|---|---|---|---|
| Group A | | | | | |
| Cyclopentasiloxane | 17.61 | 51.61 | | 16.00 | |
| Isododecane | | | 45.89 | | 19.61 |
| Isohexadecane | | | 5.00 | | 5.00 |
| Group B | | | | | |
| Quaternium-90 Bentonite Clay[6] | | 4.00 | | 1.50 | |
| Quaternium-18 Hectorite Clay[7] | 1.00 | | 3.00 | | 2.00 |
| Propylene carbonate | 0.50 | 0.50 | 0.50 | 0.50 | 0.50 |
| Group C | | | | | |
| Octyl methoxy cinnamate | | 5.00 | 5.00 | 5.00 | |
| Octyl Salicylate | | 5.00 | 5.00 | 5.00 | |
| Homosalate | | 2.50 | | 2.50 | |
| Benzophenone-1 | | 0.50 | 0.50 | 0.50 | |
| Cyclopentasiloxane and Dimethicone Copolyol[3] | 12.00 | | | 12.00 | |
| Polyhydroxystearic Acid[8] | | 0.50 | 0.50 | | |
| PEG-30 Dipolyhydroxystearate[9] | | | | | 3.00 |
| Silicone Glycol[10] | | | | | 0.50 |
| Vitamin E Acetate | | 0.50 | 0.50 | 0.50 | |
| Ethanol | | 15.00 | 20.00 | | |
| Group D | | | | | |
| Hydrophobically-treated Yellow iron oxide | 0.62 | 0.62 | | 0.62 | 0.62 |
| Hydrophobically-treated Red iron oxide | 0.18 | 0.18 | | 0.18 | 0.18 |
| Hydrophobically-treated Black iron oxide | 0.09 | 0.09 | | 0.09 | 0.09 |
| Hydrophobically-treated Titanium dioxide | 4.50 | 4.50 | | 4.50 | 4.50 |
| Hydrophobically-treated Zinc oxide | | | 6.11 | 1.00 | |
| Hydrophobically-treated Micronized (less than 3 microns) titanium dioxide | | 3.50 | 2.50 | 4.00 | |
| Hydrophobically-treated Silica | 2.00 | 1.00 | | 2.00 | 1.00 |
| Aluminum Starch Octenylsuccinate[11] | | | 3.00 | | 1.00 |
| Hydrophobically-treated Talc | 0.50 | 1.00 | | 0.50 | 0.50 |
| Boron Nitride | 1.50 | 1.50 | | 0.50 | 1.50 |
| Trimethylsiloxysilicate[5] | 2.50 | 2.50 | 2.50 | 2.50 | 2.50 |
| Polymethylsilsesguioxane | 1.50 | | | 0.50 | 1.50 |
| Group E | | | | | |
| Propylene Glycol | 55.50 | | | 39.11 | 51.00 |
| Glycerin | | | | | 5.00 |
| Water | | | | 1.00 | |

[1]Quaternium-18 Hectorite Gel: Bentone Gel VS5-PC available from Elementis Specialties

[2]Disteardimonium Hectorite Gel: Bentone Gel VS5-PCV available from Elementis Specialties

[3]Cyclopentasiloxane & Dimethicone Copolyol: DC-5225C Formulation Aid available from Dow Corning.

-continued

[4]Cetyl Dimethicone Copolymer: AbilWE-09 available from Goldschmidt.
[5]Trimethylsiloxysilicate: MQ Resin SR 1000 available from General Electric.
[6]Quaternium-90 Bentonite Clay: Tixogel VP-V available from Sud-Chemie
[7]Quaternium-18 Hectorite Clay: Bentone 38 available from Elementis Specialties
[8]Polyhydroxystearic Acid available as Arlacel P100 from Uniqema.
[9]PEG-30 Dipolyhydroxystearate available as Arlacel P135 from Uniqema.
[10]Silicone Glycol available as DC-5200 Formulation Aid from Dow Corning.
[11]Aluminum Starch Octenylsuccinate available as Dry Flo (untreated) or Natrasorb HFB (treated) from National Starch & Chemical.

Preparation Method for Composition Examples 1–5

Combine Group A ingredients and mix well with a homogenizer (i.e. Silverson Mixer) at 2000–4000 rpm. Add Group B ingredients while mixing at 5000–7000 rpm. Next, add Group C ingredients and mix at 8000–10000 rpm. After 30 minutes of mixing, check particle size with Hegman gauge or glass slides. If the sample has an acceptable particle size (i.e. less than 30 microns), slowly add Group D ingredients at a rate of 30–40 g/minute at 8000–10000 rpm. Keep the temperature at 40° C. or less. Assist with hand mixing if necessary. After addition is complete, mix for additional 5 minutes. Allow batch to reach ambient conditions and pour into appropriate container.

Preparation Method for Composition Examples 6–10

Combine Group A ingredients and mix well with a homogenizer set at 2000–4000 rpm. Add Group B ingredients without propylene carbonate at 5000–7500 rpm while adding. When addition is complete, set mixing speed to 8000–10000 rpm, and mix for 5 minutes. Keep temperature in 20–40° C. range. Add propylene carbonate and mix for additional 5 minutes. Assist with additional hand mixing if necessary. Add Group C ingredients while mixing at 5000–7000 rpm. Add Group D ingredients and mix at 8000–10000 rpm. After 30 minutes of mixing, check particle size with Hegman gauge or glass slides. If the sample has an acceptable particle size (i.e. less than 30 microns) and there is no Group E ingredient, allow batch to reach ambient conditions and pour into appropriate container. If there is a Group E ingredient, and sample passes particles size check, slowly add Group E ingredients at a rate of 30–40 g/minute at 8000–10000 rpm. Keep the temperature at 40° C. or less. Assist with hand mixing if necessary. After addition is complete, mix for additional 5 minutes. Allow batch to reach ambient conditions and pour into appropriate container.

The electronic spraying device embodiments of the present invention disclosed and represented above have many advantages. When the cosmetic foundation embodiments are applied to the face using the electrostatic spraying device of the present invention, it provides fine droplets of the cosmetic foundation on the skin, each of the droplets forming a discontinuous film having a size of from about 0.5 to about 150 microns. During use, there is no conceivable amount of electric discharge applied to the user. The cosmetic foundation applied on the face provides a natural appearance, and good wear resistance. Particularly desirable spray quality is achieved when one of the Composition Examples 1–5 is sprayed with the Device Example 1. Particularly desirable spray quality is also achieved when Composition Example 6 is sprayed with Device Example 2.

It is understood that the foregoing detailed description of examples and embodiments of the present invention are given merely by way of illustration, and that numerous modifications and variations may become apparent to those skilled in the art without departing from the spirit and scope of the invention; and such apparent modifications and variations are to be included in the scope of the appended claims.

What is claimed is:

1. An electrostatic spraying device being configured and disposed to electrostatically charge and dispense a liquid composition from a supply to a point of dispersal, wherein the device comprises:

a reservoir configured to contain the supply of liquid composition;

a nozzle to disperse the liquid composition, the nozzle being disposed at the point of dispersal;

a channel disposed between the reservoir and the nozzle, wherein the channel permits the electrostatic charging of the liquid composition upon the liquid composition moving within the channel;

a high voltage power supply electrically connected to a power source; and a high voltage electrode electrically connected to the high voltage power supply, wherein a portion of the high voltage electrode is disposed between the reservoir and the nozzle, and wherein the high voltage electrode electrostatically charges the liquid composition within the channel at a charging location, wherein the nozzle pathway comprises an outlet path disposed adjacent to the nozzle, the outlet path having a diameter of from about 0.1 mm to about 1 mm or and having a length greater than 0 mm to about 5 mm, and a main path disposed between the outlet path and the charging location, the main path having a diameter greater than outlet path and being outwardly tapered towards the changing location at an angle greater than 0 to about 10 degrees.

2. The electrostatic spraying device of claim 1, wherein the high voltage electrode comprises an antenna for facilitating flow of the liquid composition in the nozzle pathway, the antenna projecting at substantially the center of the nozzle pathway and having a basal diameter of from about 0.5mm to about 7 mm, and a eight of from about 0.5mm to about 7mm.

3. The electrostatic spraying device of claim 1, wherein the outlet path has a length of from about 0.5 mm to about 3 mm, and the main path is outwardly tapered at an angle of from about 3 degrees to about 7 degrees.

4. The electrostatic spraying device of claim 3, wherein when the main path is outwardly tapered towards the charging location at an angle, the antenna is inwardly tapered towards the nozzle at an angle of from about 0 degrees to about 30 degrees.

5. The electrostatic spraying device of claim 1 further comprising a positive displacement mechanism to move the liquid composition from the reservoir to the nozzle.

6. The electrostatic spraying device of claim 1, wherein a high voltage shield substantially surrounds the reservoir, the high voltage shield being conductive.

7. The electrostatic spraying device of claim 1, wherein the high voltage power supply is configured to supply a variable output signal in response to a feedback signal, the feedback signal monitored at the high voltage electrode.

8. The electrostatic spraying device of claim 1, wherein at least the reservoir, the nozzle, the channel, the high voltage electrode, and the nozzle pathway are part of a removable cartridge which contains and delivers the liquid composition.

9. The electrostatic spraying device of claim 1, comprising the liquid composition in the reservoir, the liquid composition being an emulsion composition comprising:

(a) from about 5% to about 75% of an insulating external phase comprising one or more liquid insulating materials; and (b) from about 15% to about 80% of a conductive internal phase comprising one or more conductive materials.

10. The electrostatic spraying device of claim 9, wherein the emulsion composition further comprises a film forming polymer.

11. The electrostatic spraying device of claim 9, wherein the emulsion composition further comprises a particulate pigment.

12. A method of treating the skin, comprising electrostatically spraying the emulsion composition by the electrostatic spraying device of claim 9, wherein a plurality of droplets of the emulsion composition are applied on the skin.

13. A method of treating the skin comprising electrostatically spraying the emulsion composition by the electrostatic spraying device of claim 9, wherein a discontinuous film of the emulsion composition is applied on the skin.

14. A removable cartridge configured to contain and deliver a liquid composition for use with an electrostatic spraying device comprising:

a reservoir configured to contain the supply of liquid composition;

a nozzle to disperse the liquid composition, the nozzle being disposed at the point of dispersal;

a channel disposed between the reservoir and the nozzle, wherein the channel permits the electrostatic charging of the liquid composition upon the liquid composition moving within the channel; and a high voltage electrode electrically connected to a high voltage contact, wherein a portion of the high voltage electrode is disposed between the reservoir and the nozzle, and wherein the high voltage electrode electrostatically charges the liquid composition within the channel at a charging location;

wherein a nozzle pathway comprises an outlet path disposed adjacent to the nozzle, the outlet path having a diameter of from about 0.1 mm to about 1 mm and having a length greater than 0 mm to about 5 mm and a main path disposed between the outlet path and the charging location, the main path having a diameter greater than a diameter of the outlet path and being outwardly tapered towards the charging location at an angle greater than 0 to about 10 degrees.

15. The removable cartridge of claim 14, wherein the high voltage electrode comprises an antenna for facilitating flow of the liquid composition in the nozzle pathway, the antenna projecting at substantially the center of the nozzle pathway and having a basal diameter of from about 0.5 mm to about 7 mm, and a height of from about 0.5 mm to about 7 mm.

16. The removable cartridge of claim 14, wherein the outlet path has a length of from about 0.5 mm to about 3 mm, and the main path is outwardly tapered at an angle of from about 3 degrees to about 7 degrees.

17. The removable cartridge of claim 14, wherein when the main path is outwardly tapered towards the charging location at an angle, the antenna is inwardly tapered towards the nozzle an angle of from about 0 degrees to about 30 degrees.

18. The removable cartridge of claim 14 further comprising a positive displacement mechanism to move the liquid composition from the reservoir to the nozzle.

19. The removable cartridge of claim 14, wherein a high voltage shield substantially surrounds the reservoir, the high voltage shield being conductive.

20. The removable cartridge of claim 14 comprising the liquid composition in the reservoir; the liquid composition being an emulsion composition comprising:

(a) from about 5% to about 75% of an insulating external phase comprising one or more liquid insulating materials; and (b) from about 15% to about 80% of a conductive internal phase comprising one or more conductive materials.

* * * * *